United States Patent [19]

Klose

[11] 4,422,315

[45] Dec. 27, 1983

[54] KEY HOLDER

[75] Inventor: Odo Klose, Wuppertal, Fed. Rep. of Germany

[73] Assignee: Präsenta KG Weber & Co., Solingen, Fed. Rep. of Germany

[21] Appl. No.: 280,970

[22] Filed: Jul. 7, 1981

[30] Foreign Application Priority Data

Jul. 24, 1980 [DE] Fed. Rep. of Germany ..... 3027979

[51] Int. Cl.[3] ..... A44B 15/00; A45C 11/32

[52] U.S. Cl. ..... 70/456 R

[58] Field of Search ..... 70/456 R, 457, 458, 70/459; 150/40

[56] References Cited

U.S. PATENT DOCUMENTS

| | | | |
|---|---|---|---|
| 2,465,328 | 3/1949 | Modrey | 70/459 |
| 2,490,396 | 12/1949 | Leff | 70/456 R |
| 2,896,290 | 7/1959 | Salm et al. | 70/456 R |
| 2,964,937 | 12/1960 | Lautin | 70/458 X |
| 3,023,603 | 3/1962 | Bowen | 70/456 R |
| 3,101,762 | 8/1963 | Bermingham et al. | 150/40 |
| 3,600,917 | 8/1971 | Krock | 70/457 X |
| 3,765,201 | 10/1973 | Humphrey | 70/456 R |
| 4,037,443 | 7/1977 | Motzer | 70/459 |
| 4,079,607 | 3/1978 | Spruyt | 70/456 R |

FOREIGN PATENT DOCUMENTS

| | | | |
|---|---|---|---|
| 961011 | 1/1975 | Canada | 70/456 R |
| 7903867 | 2/1979 | Fed. Rep. of Germany . | |
| 1258893 | 3/1960 | France | 70/459 |

*Primary Examiner*—Thomas J. Holko
*Assistant Examiner*—Lloyd A. Gall
*Attorney, Agent, or Firm*—Martin A. Farber

[57] ABSTRACT

A key holder comprising a plate provided with an elastic ring and a detent pawl is insertable into a flat sleeve. The plate has a notch which receives an end section of the ring. The end section is non-displaceable in its fully inserted position since the notch lies within the opening shaft of the flat sleeve.

14 Claims, 9 Drawing Figures

KEY HOLDER

The present invention relates to a key holder having at least one elastic ring which can be inserted through a hole in a key head, which ring is continued by sections which can be inserted into a flat sleeve and held therein in a detent position.

Such a key holder is known from West German Utility Model 7 903 867, the sections which adjoin the elastic ring being developed as spring legs provided with a hook at their end which, in the inserted position, engage behind inwardly bent oppositely located holding tongues of the flat sleeve which are produced by cuts. This structural form is not very reliable in use. The detent position can be released by unintended lateral pressure on the elastic ring, for instance when the key holder is carried in one's pocket. The ring slides out and the keys can then fall off the ring.

The object of the present invention is to develop a key holder of the afore-mentioned type in an easily manufactured manner in such a way that, in addition to easy attachment of the keys to the ring, a secure position of use is present so that keys can be removed from the key holder only by intentional action.

In accordance with the invention there is provided the ring (6) extending from the one side edge (20) of a plate (3) which is insertable into the flat sleeve (1, 36, 38) and terminates in a notch (24) formed on the other lengthwise side edge (23) of the plate (3), the notch (24), in the inserted position, lying within the shaft (16) of the flat sleeve, the wall of which is formed with an opening (2) for snapping therein a detent pawl of the plate (3), the latter being formed as a push button (8).

As a result of this development, there is obtained a key holder of the afore-mentioned type which is of increased value in use. The adding of keys to the key holder is effected with, the plate not being inserted, and the free end of the ring is swung out of the notch in order to place the key or keys on it. After the keys have been placed on, the end returns into the notch as a result of the elasticity of the ring. The final securing of the keys is effected only upon the insertion of the plate into the flat sleeve, the detent pawl being capable, in the fully inserted position, of engaging into the opening in the wall of the flat sleeve. In the fully inserted position the notch then is contained within the shaft of the flat sleeve so that displacement of the end of the elastic ring present in the notch is impossible. The removal of keys from the key holder must therefore be effected in an intentional manner. This requires first of all pulling out the plate with the ring seated thereon after depressing the push button and then swinging out the end of the ring which lies within the notch. The plate therefore in principle assures two safety functions. Since the push button of the plate, developed as detent pawl, lies in the wall of the flat sleeve, it is in a protected position which opposes the unintentional release of the detent pawl.

One further advantageous embodiment is that the ring projects beyond the lengthwise edge of the shaft of the flat sleeve.

Another advantage is that the snap-in opening (2) is arranged in a wide side wall (11 or 37) of the flat sleeve (1 or 36) and the detent pawl (8) is formed as free-cut circular surface which protrudes rising obliquely from the plane of the plate in the direction towards the ring. During the insertion movement the detent pawl is pressed in the inward direction. Only when it comes into position aligned with the snap-in opening which has a corresponding cross section does it spring into its detent position and secure the position of the flat sleeve and plate with respect to each other. The circular shape of the detent pawl and the snap-in opening assures a favorable manufacture.

The security of the key holder is increased by the notch being of angular formation and an arm (24) of the notch extending transversely to the direction of insertion of the plate. If the ring with the plate is contained within the flat sleeve, the transversely directed end section (7) of the ring cannot be moved out of the notch even by exerting a large force on the ring.

When the plate with the ring is made of plastic having corresponding resilient properties it is advantageous for an angularly bent section (7) of the ring to lie with play within the transversely directed notch arm (24''). In this connection it is favorable for the play to be limited by protruding points (25–27) on the wall of the notch. They can be produced during the course of the injection molding.

In order that the detent pawl does not come out of its proper position even under the action of larger forces on the ring, it has a stop (31) which strikes against the edge (2') of the opening (2) in the wall (11) of the flat sleeve.

Furthermore one advantageous feature resides in the fact that the plate is round at its insertion end (32) and has spring tongues (33, 34) which rest against the bottom of the shaft of the flat sleeve (1, 36, 38). In the fully inserted position the spring tongues are under tension and assure a firm resting of the edge of the detent pawl facing the ring against the corresponding section of the wall of the snap-in opening. This rounded end provided with spring tongues permits easy introduction of the plate into the flat sleeve.

Another embodiment is featured by two plates which can be inserted in opposite directions into a flat sleeve (36, 38).

In another embodiment the two plates can overlap (FIGS. 8, 9).

With the above and other objects and advantages in view, the present invention will become more clearly understood in connection with the detailed description of preferred embodiments, when considered with the accompanying drawings, of which:

Figure 1:
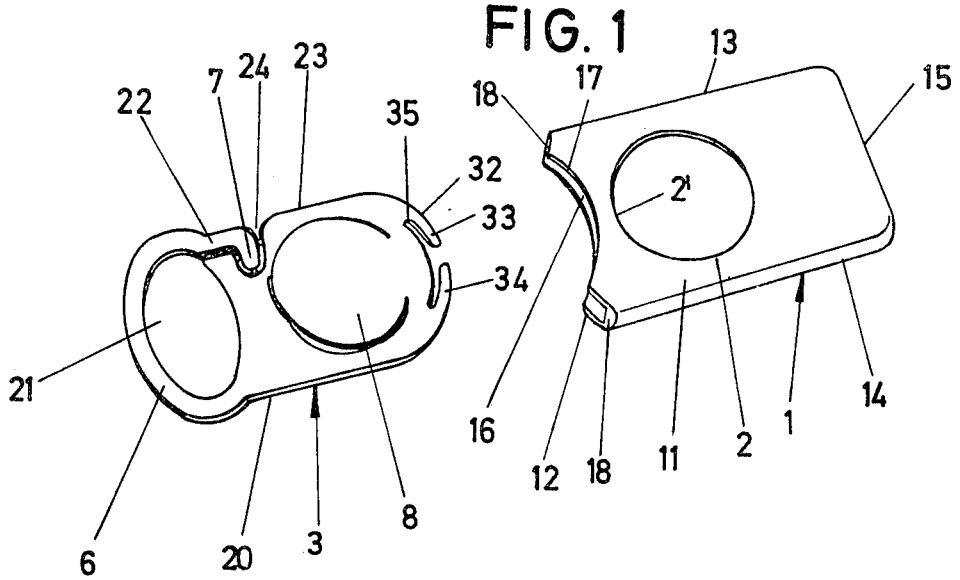
FIG. 1 shows in perspective exploded view, a key holder in accordance with the first embodiment, the ring which is continued by a plate not yet being inserted.

In accordance with the first embodiment, the key holder has a flat sleeve 1 made of plastic. It is formed of the two wide side walls 11 and 12, lengthwise walls 13 and 14 and a bottom 15. In this way an opening or shaft 16 is formed therebetween.

The wide side walls 11, 12 of the flat sleeve 1 are developed to form a throat 17 which passes into sections 18 which extend obliquely into the lengthwise walls 13, 14.

A snap-in opening 2 of circular cross section is formed in one wide side wall 11.

From the bottom 15 of the flat sleeve 1, supporting ribs 19 extend symmetrically to the line of symmetry of the flat sleeve 1, said ribs connecting the two wide side walls 11, 12 to each other and terminating at a distance in front of the snap-in opening 2.

The flat sleeve 1 cooperates with a plate 3 adapted to be pushed into it. This plate also is made of suitable plastic. An elastic ring 6 extends from one side edge 20 of the plate. Together with the plate 3 it forms an oval opening 21. The ring 6 terminates in a bent end section 7 which is bent off transversely to the direction of insertion of the plate into the sleeve, said section adjoining a linear section 22 of the ring 6. The linear section 22 in its turn has an outermost side edge substantially aligned with the side edge 23 which is opposite the side edge 20.

The linear section 22 and the bent section 7 extend into an angular notch 24 of the plate in such a manner that the linear section 22 of the ring lies with play in one arm 24' of the notch and the bent section 7 lies with play in the other arm 24" of the notch. In order to limit the play, three projecting points 25, 26 and 27 are provided on the wall of the notch. The points 25, 27 are located opposite each other and extend in the direction of insertion while the point 26 faces the end edge of the bent section 7.

On its insertion end portion the plate 3 has a detent pawl 8 developed as push button. It is formed as a free-cut projecting circular surface which rises obliquely from the plane of the plate in the direction towards the ring 6. The free-cut extends over such an angle that the remaining bridge of material faces the insertion end (the right side in FIG. 2) of the plate. In the region of the bridge of material, a hinge is formed by a groove 30 which extends transversely to the insertion direction, the detent pawl being swingable around said hinge.

The detent pawl 8 has an arcuately extending stop 31 on its edge R which edge is on a side opposite the groove 30.

As can be noted from the drawings, the plate 3 is rounded on its insertion-side 32 and is provided there with two spring tongues 33, 34 which are formed by an arcuate slot 35.

Figure 2:
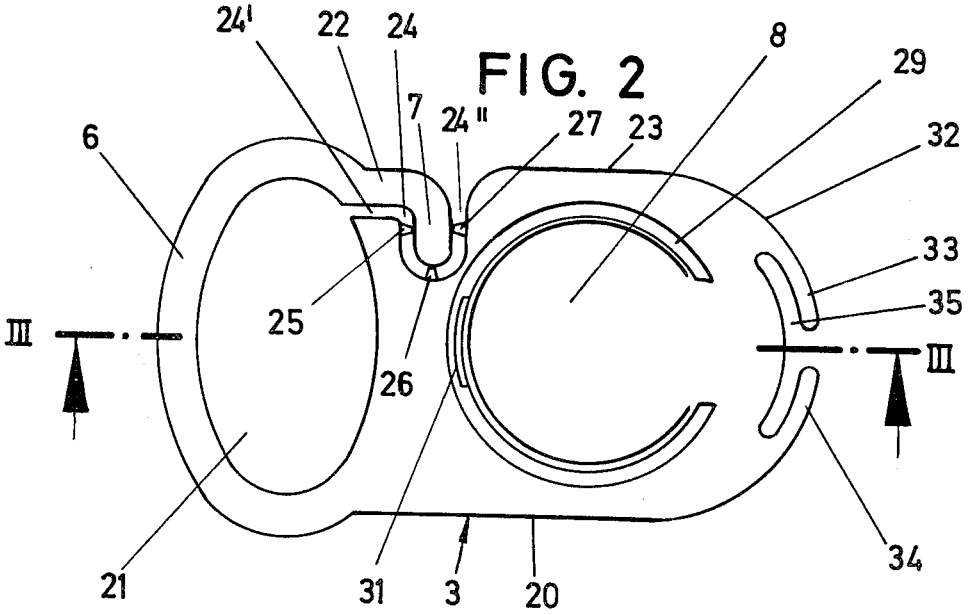
FIG. 2 shows on a larger scale a top view of the plate and ring.
Figure 3:
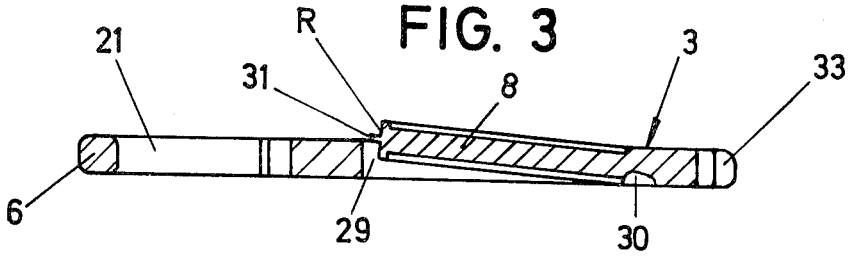
FIG. 3 is a section along the line III—III of FIG. 2.
Figure 4:
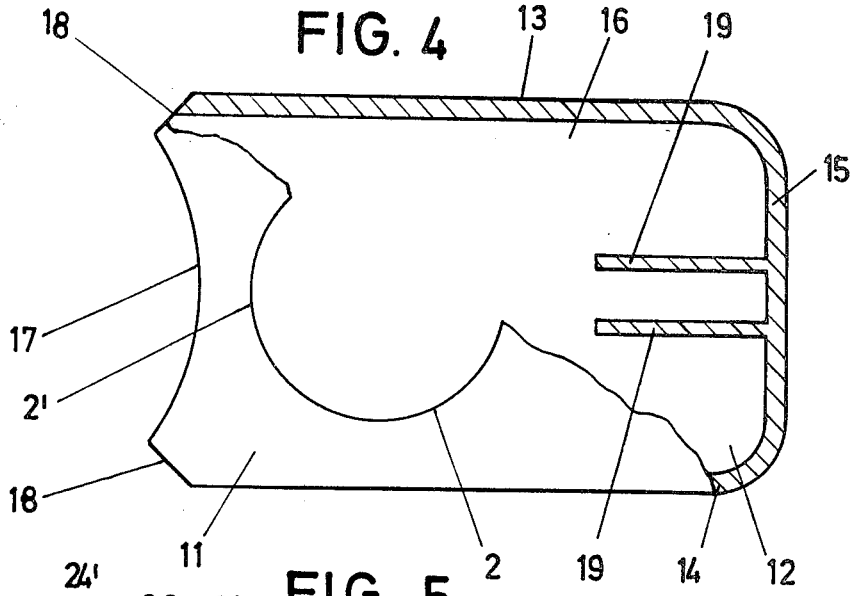
FIG. 4 shows the flat sleeve on a larger scale, partly in top view and broken away partly in section.

From FIG. 2 is can be seen that the ring 6 protrudes beyond the side edges 20, 23 of the plate 3. The distance between the two side edges 20, 23 is somewhat less than the distance between the two lengthwise side edges of the shaft 16.

Figure 6:
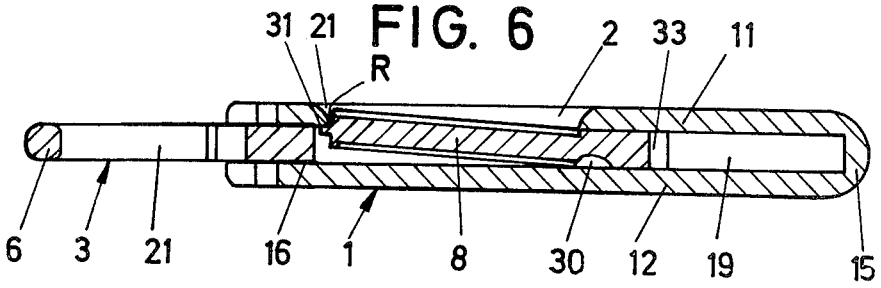
FIG. 6 is a section along the line VI—VI of FIG. 5.

If keys are to be attached to the plate 3, the elastically deformable ring 6 is swung in such a manner that the bent section 7 of the ring 6 leaves the notch 24. The keys can then be placed on. After release of the end of the ring, the section 7 moves back into the notch 24. The plate 3 can now be inserted into the sleeve 1. In the completely inserted position the spring tongues 33, 34 strike the stays ribs 19 which extend from the bottom 15 of the flat sleeve while the detent pawl 8 extends snapping into the snap-in opening 2 of the flat sleeve. The spring tongues 33, 34 now cause the side edge R of the detent pawl 8 which faces the ring 6 to come against the wall section 2' of the snap-in opening 2. In this position, the stop 31 of the detent pawl is located below the wall section 2' so that it cannot swing out of the opening 2; see in particular FIG. 6.

Figure 5:
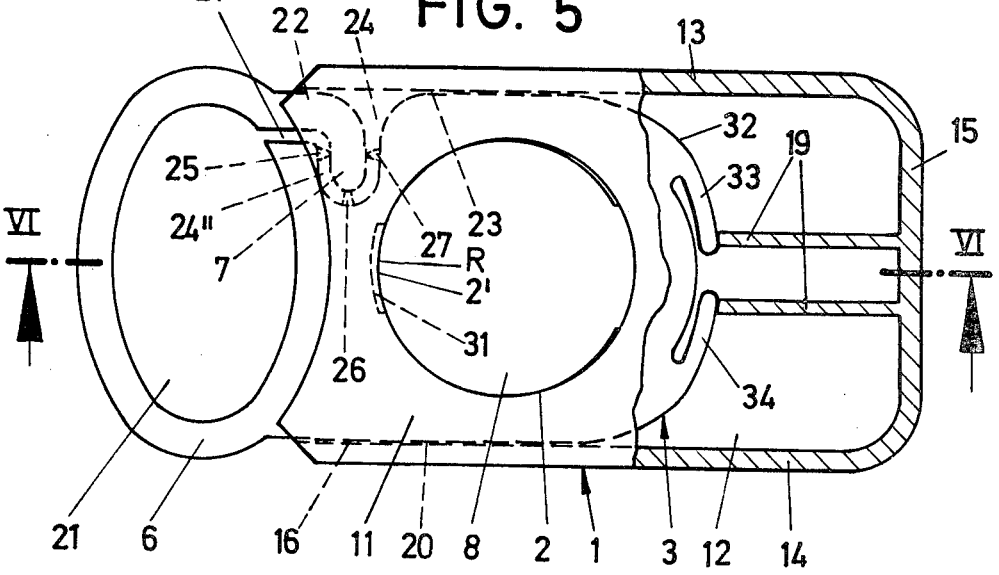
FIG. 5 shows the plate inserted in the flat sleeve, partly in top view and broken away partly in section.

In the fully inserted position the notch 24 lies inside the region of the shaft 16 of the flat sleeve. This means that the bent section 7 of the ring 6 is prevented from swinging out; see FIG. 5.

The removal of the plate 3 from the flat sleeve 1 requires pushing the detent pawl 8 inwardly. For this the force of the spring tongues 33, 34 engaging the ribs 19 must be overcome. Only when the detent pawl 8 has moved completely out of the opening 2 into the flat sleeve 1 can the plate 3 be pulled out.

Figure 7:
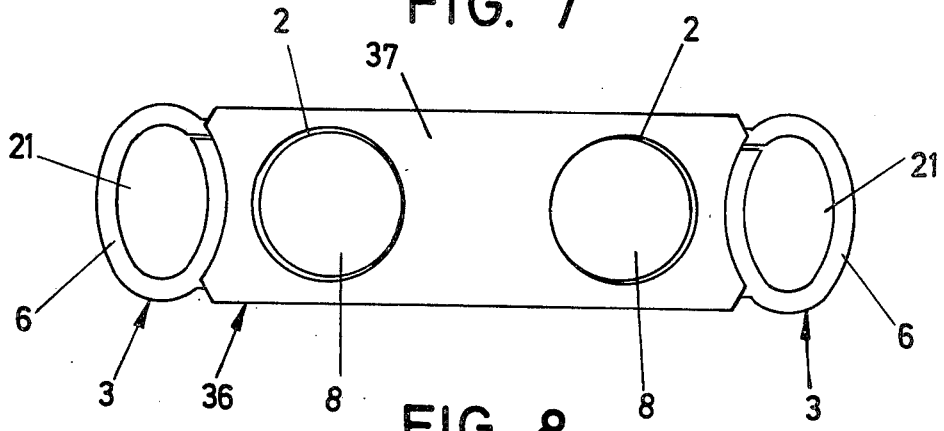
FIG. 7 shows a second embodiment of the key holder, a flat sleeve receiving two plates disposed in a single plane and pushed in from opposite directions.

The second embodiment, shown in FIG. 7, has a modified flat sleeve 36. It is about twice as long as the flat sleeve 1. On the opposite narrow sides of the flat sleeve 36 there are similarly formed shafts. Furthermore two snap-in openings 2 are provided on one wide side wall 37, said openings cooperating with the detent pawls 8 of the plates 3 respectively, which are to be inserted. The flat sleeve 36 in this embodiment also has ribs (not shown) which act on the spring tongues (33, 34) also not shown in FIG. 7 of the plates 3.

Figure 8:
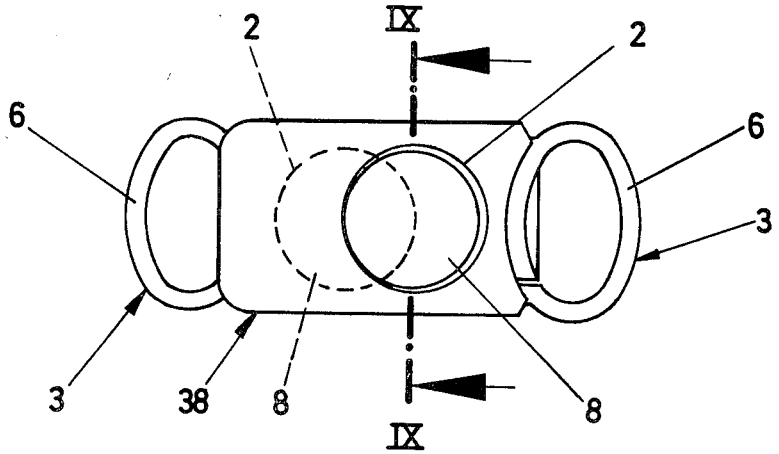
FIG. 8 shows a third embodiment of the key holder in which plates are pushed in from opposite directions, the plates, however, overlapping.
Figure 9:
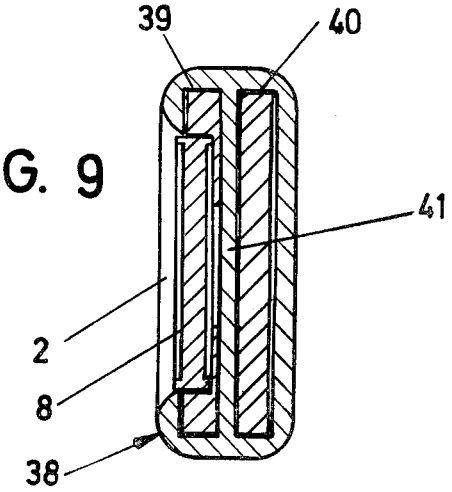
FIG. 9 is a section along the line IX—IX of FIG. 8.

In the third embodiment, shown in FIGS. 8 and 9, plates 3 can also be inserted in opposite directions into a flat sleeve 38. The flat sleeve 38 is formed for this purpose with two shafts 39, 40 which lie parallel to each other and extend from opposite directions, the shafts being separated from each other by a partition wall 41. The snap-in openings 2 which cooperate with the detent pawls 8 of the plates 3 are provided on the opposite outer wide side walls, respectively, of the flat sleeve 38.

I claim:

1. In a key holder having at least one elastic ring which can be inserted through a hole in a key head, which ring is continued by sections which can be inserted into a flat sleeve and held therein in a detent position, the improvement wherein said sleeve has a wall forming at least one shaft and an opening formed in said wall, at least one plate having the ring extending from one side edge of said plate in one piece therewith and in the same plane therewith, said plate being insertable into said shaft of said flat sleeve, said plate is made of elastic material and is formed with a notch on another side edge thereof, said notch in an inserted position of said plate in said sleeve is disposed within said shaft of said flat sleeve, said ring has an end extending freely with inherent elastic biasing into said notch such that said end is bendable out of said notch and automatically returnable therein upon release by the elastic biasing, said plate forms a detent pawl formed as a push button, said detent pawl snaps into said opening in said wall of said flat sleeve in said inserted position, said sleeve constitutes means for securing said end of said ring in three dimensions in cooperation with said notch when said plate is in said inserted position in said sleeve, whereby said end of said ring is held substantially immovable in three-dimensions in said inserted position of said plate in said shaft of said sleeve, via said sleeve and said notch, and respectively when said end of said ring is moved out of said shaft after release of said detent pawl from said opening said end of said ring is automatically free to be bent open out of said notch for the insertion and removal of keys.

2. In a key holder having at least one elastic ring which can be inserted through a hole in a key head, which ring is continued by sections which can be inserted into a flat sleeve and held therein in a detent position, the improvement comprising said sleeve has a wall forming at least one shaft and an opening formed in said wall, at least one plate having the ring extending from one side edge of said plate, said plate being insertable into said shaft of said flat sleeve, said plate is formed with a notch on another side edge thereof, the latter constituting a lengthwise side edge of said plate, said notch in an inserted position of said plate in said sleeve is disposed within said shaft of said flat sleeve, said ring has an end extending into said notch, said plate has a detent pawl formed as a push button, said detent pawl snaps into said opening in said wall of said flat sleeve in said inserted position, said notch has an angular formation defining a transversely directed arm of said notch extending in a transverse direction relative to a direction of insertion of the plate into said sleeve, said end of said ring is an angularly bent section of said ring and is disposed with play partially in said transversely directed arm of said notch, and said plate has points projecting therefrom into said notch, said points limit the play in said notch of said bent section of the ring.

3. In a key holder having at least one elastic ring which can be inserted through a hole in a key head, which ring is continued by sections which can be inserted into a flat sleeve and held therein in a detent position, the improvement wherein said sleeve has a wall forming at least one shaft and an opening formed centrally in said wall spaced from ends of the sleeve, at least one plate made of elastic material and having the ring extending at a plate end from one side edge of said plate in one piece and in one plane therewith, said shaft and said plate having substantially the same thickness and width, said plate being insertable into said shaft of said flat sleeve, said plate is formed with a notch extending substantially transversely inwardly into said plate on another side edge thereof, said side edges constitute lengthwise side edges of said plate, said notch in an inserted position of said plate in said shaft of said sleeve is disposed within said shaft of said flat sleeve with a central portion of said ring projecting out of said sleeve, said ring is elastic and has an end formed substantially in hook-shape extending substantially transversely inwardly at a free end thereof into said notch, said end of said ring is bendable out of said notch for inserting and removing keys therefrom and formed such that by the elasticity of said ring, in a released condition, said end of said ring automatically reenters said notch, and said notch is formed with a dimension in the lengthwise direction of the plate substantially equal to that of said free end of said ring such that said transversely extending free end of said ring is held substantially without play in the lengthwise direction of said plate when said free end is in said notch, said plate has an elastic detent pawl formed as a push button biased in a direction extending obliquely partially out of said one plane of said plate, said detent pawl being formed in one piece with said plate, the elasticity of the material of the plate providing the elasticity of the ring and of said detent pawl in cooperation with their formation, said detent pawl snaps into said opening in said wall of said flat sleeve partially out of said one plane of said plate in said inserted position releasably locking said plate in said sleeve, said end of said ring in said shaft in said sleeve in said inserted position of said plate in said shaft of said sleeve substantially abuts an inner narrow side of said sleeve, whereby said end of said ring is held, substantially immovable, in three-dimensions in said inserted position of said plate in said shaft, via said sleeve and said notch, and respectively when said end of said ring is moved out of said shaft of said sleeve after release of said detent pawl from said opening, said end of said ring is automatically free to be bent open out of said notch for the insertion and removal of keys.

4. The key holder according to claim 3, wherein said ring projects beyond a lengthwise narrow side edge of said shaft of said sleeve.

5. The key holder according to claim 3, wherein said opening constituting a snap-in opening is formed in a wide side wall portion of said wall of said sleeve, said detent pawl is formed as a partial free-cut circular surface extending and rising obliquely from the plane of said plate in a direction towards said ring.

6. The key holder according to claim 3, wherein said notch has an angular formation defining a transversely directed arm of said notch extending in a transverse direction relative to said lengthwise direction, the latter constituting the direction of insertion of the plate into said shaft of said sleeve.

7. The key holder according to claim 6, wherein said hook-shaped end of said ring is an angularly bent section of said ring and is disposed with transverse outwardly directed play partially in said transversely directed arm of said notch.

8. The key holder according to claim 3, wherein said detent pawl has a stop which abuts against an edge portion of the opening of the wall of said flat sleeve.

9. The key holder according to claim 3 or 8, wherein said plate defines an insertion end which is round and has spring tongues which pressingly engage against a bottom of said shaft of the flat sleeve in said inserted position.

10. The key holder according to claim 3 or 8, wherein said sleeve is formed with a bottom of said shaft and ribs project from said bottom into said shaft, said plate defines an insertion end which is round and has spring tongues which pressingly engage against said ribs in said shaft of the flat sleeve in said inserted position.

11. The key holder according to claim 3, wherein said sleeve is formed with entrances to said at least one shaft at opposite narrow ends of said sleeve, two of said plates are insertable in opposite directions into said entrances, respectively, in said flat sleeve.

12. The key holder according to claim 11, wherein said wall includes a partition in said sleeve and forms two of said shafts, said two plates are insertable in said two shafts, respectively, and overlap in the inserted position.

13. The key holder according to claim 7, wherein said angularly bent section of said ring includes a linear section extending in said lengthwise direction and has an outermost lengthwise side edge substantially aligned with said lengthwise another side edge of said plate, said angular formation of said notch defines another arm of said notch inwardly spaced from said lengthwise another side edge of said plate, said linear section of said end of said ring is normally disposed in said another arm of said notch and extends parallel to said direction of insertion.

14. The key holder according of claim 5, wherein said detent pawl is hinged in one piece to said plate by a bridge of material of the plate facing away from said ring, said bridge of material is defined by a groove in said plate on a side of said plate opposite the direction in which said detent pawl extends obliquely partially out of said one plane of said plate.

* * * * *